US005713679A

United States Patent [19]

Taylor

[11] Patent Number: 5,713,679

[45] Date of Patent: Feb. 3, 1998

[54] APPARATUS FOR SELECTIVELY DISPENSING LINER-TYPE AND LINERLESS-TYPE LABELS

[75] Inventor: Bruce E. Taylor, Tipp City, Ohio

[73] Assignee: Monarch Marking Systems, Inc., Dayton, Ohio

[21] Appl. No.: 727,722

[22] Filed: Oct. 7, 1996

[51] Int. Cl.[6] ..... B41J 11/26

[52] U.S. Cl. ..... 400/621; 156/384; 156/540; 156/541; 156/363; 156/584

[58] Field of Search ..... 400/621, 611, 400/612; 101/288; 156/384, 387, 363, 538, 540, 541, 542, 543, 584

[56] References Cited

U.S. PATENT DOCUMENTS

| | | | |
|---|---|---|---|
| 3,837,966 | 9/1974 | Finke . | |
| 4,264,396 | 4/1981 | Stewart . | |
| 4,670,085 | 6/1987 | van der Meer et al. | 156/344 |
| 4,824,577 | 4/1989 | Leahy | 156/584 |
| 5,013,388 | 5/1991 | Goodwin et al. . | |
| 5,259,681 | 11/1993 | Kitazawa et al. | 400/621 |
| 5,487,337 | 1/1996 | Uland . | |
| 5,609,714 | 3/1997 | Whiteside et al. | 156/387 |
| 5,643,392 | 7/1997 | Clough | 156/584 |

*Primary Examiner*—Eugene H. Eickholt

[57] ABSTRACT

There is disclosed a printer and a method for printing and dispensing either liner-type or linerless-type labels. A delaminator is selectively positionable so that the carrier web of a liner-type composite label web can be drawn about the delaminator to delaminate and dispense a pressure sensitive label or so that the delaminator is out of the way to avoid problems when using the printer to print and dispense linerless-type labels. The linerless-type label web is prepared by folding an end portion upon itself to facilitate threading through a printer.

15 Claims, 2 Drawing Sheets

APPARATUS FOR SELECTIVELY DISPENSING LINER-TYPE AND LINERLESS-TYPE LABELS

BACKGROUND OF THE INVENTION

1. Field of the Invention

This invention relates to the label and label dispensing art.

2. Brief Description of the Prior Art

The prior art includes apparatus for dispensing liner-type labels such as U.S. Pat. Nos. 3,837,966; 4,264,396; and 5,013,388 and apparatus for dispensing linerless-type labels such as U.S. Pat. No. 5,487,337.

SUMMARY OF THE INVENTION

It is a feature of the invention to provide improved method and apparatus by which the same apparatus can be used to dispense either labels from liner-type composite webs or linerless-type webs.

In one specific embodiment of the apparatus of the invention, there is provided a printer with a print head for printing on labels and a cooperable platen for supporting a web of the labels at a printing position. There is a drive mechanism for advancing the web of labels. The apparatus can be used to dispense liner-type labels wherein a series of labels are releasably adhered to a carrier web by pressure sensitive adhesive. The apparatus can also be used to dispense linerless-type labels wherein a series of labels or records are arranged in a web and the labels have pressure sensitive adhesive on one side of the web. There is a delaminator for delaminating labels from the carrier web of the liner-type composite label web. A positioning mechanism is provided for selectively positioning the delaminator in one position relative to the print head for delaminating labels from the carrier web of a liner-type composite web, and positioning the delaminator in another position to avoid interfering with the dispensing of linerless labels.

It is another feature of the invention to provide an improved linerless label web which is easy to thread into a printer because the end portion of the web is folded upon and adhered to itself. The folding is preferably done at a lateral line of perforations which separates the web into adjacent connected labels. The linerless web prepared in this manner is now threaded into a printer.

Other features will be evident to one of ordinary skill in the art from the specification and the accompanying drawings.

DETAILED DESCRIPTION OF PREFERRED EMBODIMENTS

Figure 2:
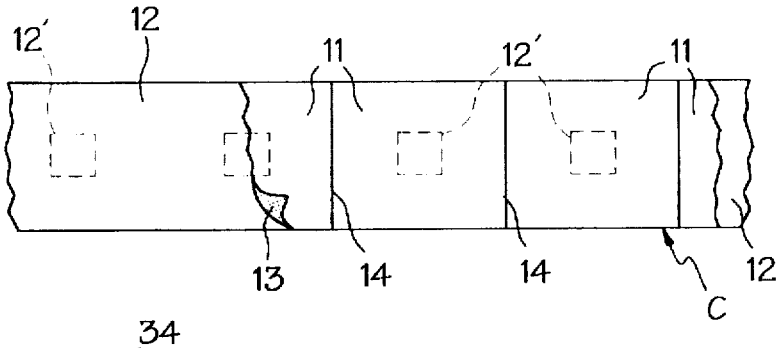
FIG. 2 is a top plan fragmentary view of liner-type composite label web.
Figure 3:
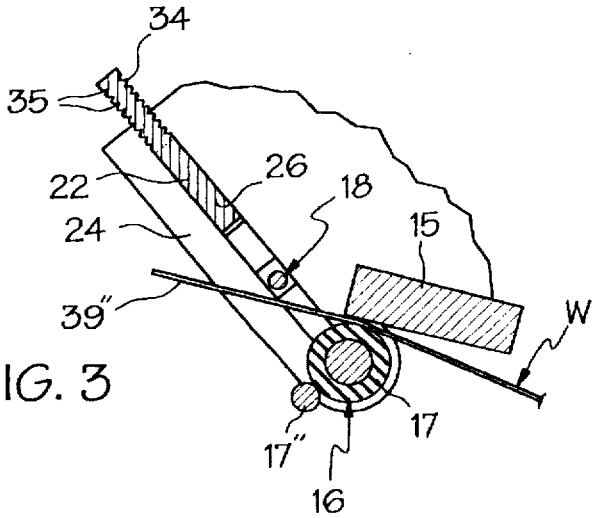
FIG. 3 is a view similar to FIG. 1 but showing the printer used with a linerless-type label web.
Figure 4:
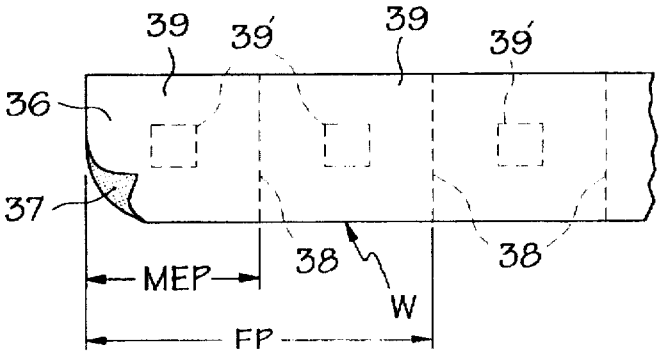
FIG. 4 is a top plan fragmentary view of a linerless-type label web.

The drawings show a printer generally indicated at 6 for printing either on a liner-type composite label web C (FIGS. 1 and 2) or on a linerless-type label web W (FIG. 3 and 4). The printer 6 is shown to mount a roll 7 of the web C. The roll 7 has a core 8 mounted on a suitable mounting member 9. The web C passes from the roll 7 about a roller 10.

Figure 1:
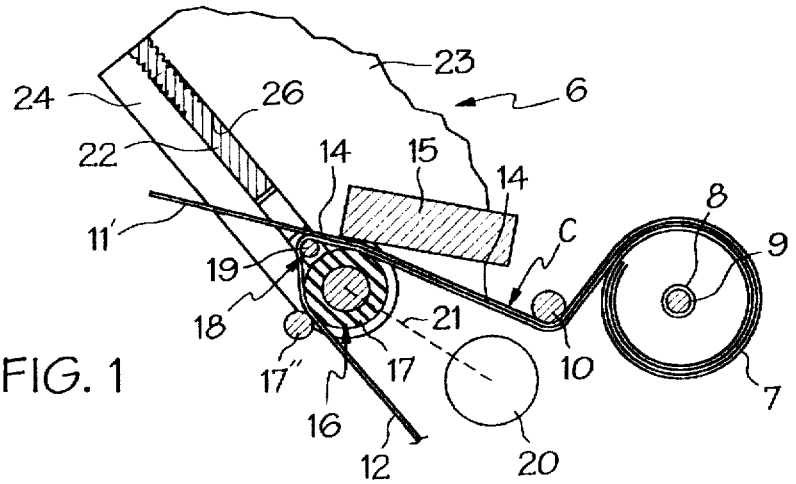
FIG. 1 is a diagrammatic side elevational view of a printer with a printing mechanism and a delaminator used with a liner-type composite label web.

With reference to FIGS. 1 and 2, the web C is shown to be comprised of a series of pressure sensitive labels 11 releasably adhered to a carrier web 12 by pressure sensitive adhesive 13. The labels 11 are made by butt-cutting laterally or transversely at equally longitudinally spaced intervals as indicated at 14. Registration marks 12' on the underside of the carrier web 12 or feed cuts (not shown) in the carrier web can be used to register the labels 11 with the printer 6.

Figure 5:
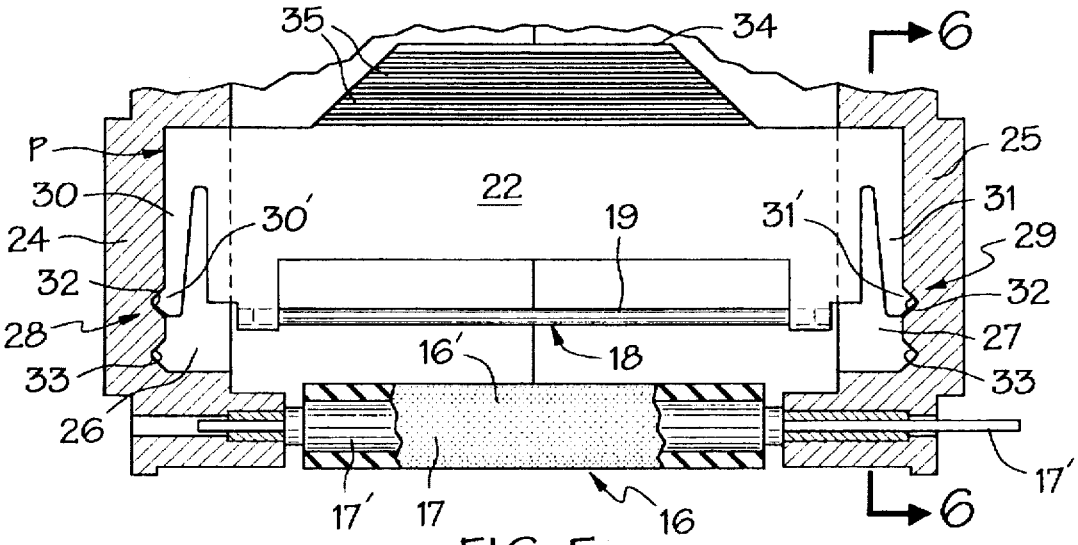
FIG. 5 is a partly sectional view showing the platen roll in relation to the delaminator positioning mechanism.
Figure 6:
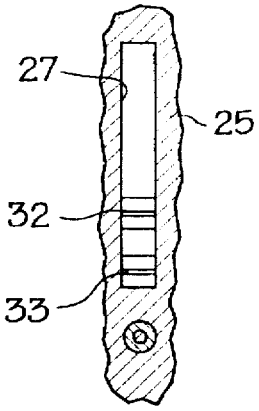
FIG. 6 is a view taken generally along line 6—6 of FIG. 5, but omitting a slide.

The printer 6 is shown to have a print head 15 cooperable with a platen generally indicated at 16 in the form of a platen roll 17. The print head 15 is illustrated to be of the thermal type wherein a line of a desired number of thermal printing elements can be provided. A delaminator generally indicated at 18 in the form of a delaminating roller or peel roller 19 is positioned as shown in FIG. 1 adjacent to the print head 15 and the platen roll 17. The print head 15 prints data while the composite web C is advancing between the print head 15 and the platen roll 17. The platen roll 17 is driven by an electric motor 20 through a drive connection 21 to platen drive shaft 17' (FIG. 5). As the composite web C advances, the carrier web 12 makes a sharp bend and passes partially about the delaminator 18. From there the carrier web 12 passes between a pressure roll 17" and the platen roll 17. The pressure roll 17" presses the carrier web 12 against the platen roll 17. As the carrier web 12 makes a sharp bend at the delaminator 18, the leading label 11' is peeled from the carrier web 12. If desired as in U.S. Pat. Nos. 4,837,966, 4,264,396 and 5,013,388, an applicator (not shown) can be positioned above the leading label 11' for application to merchandise or the like. The delaminator 18 is mounted on a slide 22 slidably mounted in a printer frame or housing 23. The slide 22 rotatably mounts the peel roller 19. The printer housing 23 has a pair of guides or guide members 24 and 25 with elongate recesses or guide slots 26 and 27. The slide 22 is received in the guide slots 26 and 27 as best shown in FIG. 5. The slide 22 has detents generally indicated at 28 and 29 comprised of flexible resilient spring fingers 30 and 31 and pairs of spaced recesses 32 and 33. The spring fingers 30 and 31 have heads or teeth 30' and 31'. FIG. 5 illustrates the setup for use with linerless-type webs W, wherein the heads 30' and 31' are received in the recesses 32. Thus, the detents 28 and 29 releasably hold the delaminator 18 in the position shown in FIGS. 3 and 5. When the slide 22 is moved to a position wherein the heads 30' and 31' are in the recesses 33, the delaminator 18 is positioned to delaminate labels 12 frown the carrier web 12 as shown in FIG. 1. The slide 22 has a manually graspable handle 34 with a series of frictional grooves 35 by which the slide 22 and the delaminator 18 can be readily grasped and positioned in either the position shown in FIG. 1 or in the position shown in FIGS. 3 and 5. The slide 22 operating in guide grooves 26 and 27 comprises a positioning mechanism for the delaminator 18 as generally indicated at P.

FIG. 4 shows a typical single-layer linerless-type label web W which has a release coating 36 on its upper surface and a coating of pressure sensitive adhesive 37 on its lower surface. The web W is shown to have lateral lines of equally longitudinally spaced perforations or perforation cuts 38 which define linerless labels 39. The perforation cuts 38 assist in tearing the labels 39 from the remainder of the web W. Printed registration marks 39' are also provided.

As seen in FIG. 3, the delaminator 18 is positioned out of the way of the linerless-type label web W, particularly the leading label 39". Accordingly, the leading label 39" will not stumble on the delaminator 18 as the label is dispensed from the printing position between the print head 15 and the platen 16. Also, there is no possibility that adhesive 37 on the underside of the leading label 39" will adhere to the delaminator 18 and cause a jam. It should be noted that the outer surface of the platen roll 17 is provided with a non-stick coating to prevent the web W from following around the platen roll 17 as the web W is being advanced.

It is thus readily apparent that the printer 10 can be used selectively with label webs of both the liner-type and the linerless type. The delaminator 18 can be positioned to be used as a delaminator for delaminating labels from a carrier web and it can be easily repositioned out of the way so as not to interfere with or impede printing and dispensing of linerless-type labels.

Although the delaminator 18 is shown to be slidably mounted, it can be selectively pivotally mounted if desired between positions wherein liner-type and linerless-type labels can be dispensed.

The delaminator 18 is shown to be selectively movable manually, however, the delaminator can be powered between selective positions as for example by an electromagnetic device (not shown).

It is apparent that the invention is useful in label dispensers, label applicators, label printer/applicator devices, and printers of various types. Although a thermal printer is illustrated, other known types of printers such as laser printers, xerographic printers, ink jet printers and the like can be used instead of a thermal printer.

Although the delaminator 18 is shown to be a peel roller 19, a fixed bar or edge can be used, if desired.

The pressure roll 17' cooperating with the driven platen roll 17 is used to advance the carrier web 12 about the delaminator 18. However, instead of using a pressure roll, a cooperating pair of drive rollers (not shown) can be used to pull or advance the carrier web 12.

Figure 7:
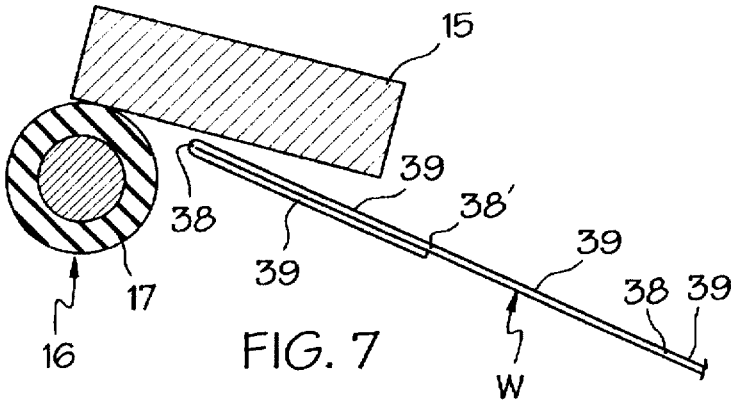
FIG. 7 is a diagrammatic fragmentary side elevational view of a prepared linerless label web about to be threaded into a printer.
Figure 8:
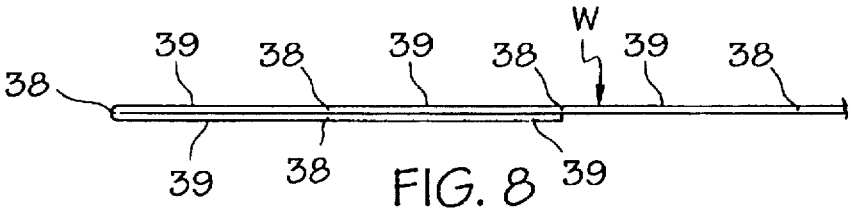
FIG. 8 is a side elevational view of a linerless label web prepared in a different way from the web shown in FIG. 7.
Figure 9:
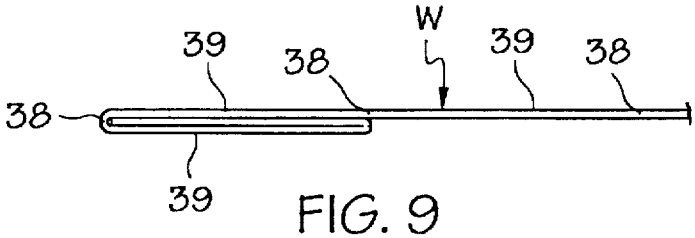
FIG. 9 is a side elevational view of a linerless label web prepared in yet another way.

With references to FIGS. 4 and 7 it is apparent that end portion EP of the linerless-type web W has been prepared so that the marginal end portion MEP is folded about a lateral line of perforations 38 to the position shown in FIG. 7. The prepared web W can then be threaded through the printer including between the print head 15 and the platen 16. This makes the web W much easier to thread and actually prevents the wasting of labels 39. In certain printers the label roll is in a confined space and/or the label web is required to pass over guides and/or one or more guide rollers, making threading of the printer all the more difficult, absent the invention. The adhesive 37 on the underside of the endmost label 39 is shown adhered to the adhesive 37 on the underside of the adjacent label 39. When the prepared web W exits the printer 6, the web W can be torn at one of the lines of perforation 38' and the folded over and adhered labels 39 can be discarded. The labels 39 can be of any desired length in the longitudinal direction, so it may be desired to fold the end portion EP so that two or more labels 39 are folded onto and adhered to a corresponding number of adjacent labels as shown in FIG. 8. FIG. 9 shows an arrangement by which end portion EP is folded more than once to achieve the desired result.

Other embodiments and modifications of the invention will suggest themselves to those skilled in the art, and all such of these as come within the spirit of this invention are included within its scope as best defined by the appended claims.

I claim:

1. A printer for printing and selectively dispensing liner-type labels wherein pressure sensitive labels are releasably adhered to a carrier web and linerless-type pressure sensitive labels arranged in a web, comprising: a print head for printing on labels, a drive mechanism for advancing a web of labels of either the liner-type or the linerless type, a delaminator for delaminating labels from a carrier web, and a positioning mechanism for selectively positioning the delaminator in a first position for delaminating and dispensing liner-type labels from a carrier web and in a second position for dispensing linerless-type labels.

2. A printer as defined in claim 1, wherein the print head comprises a thermal print head.

3. A printer for printing and selectively dispensing liner-type labels wherein pressure sensitive labels are releasably adhered to a carrier web and linerless-type pressure sensitive labels arranged in a web, comprising: a print head for printing on labels, a drive mechanism for advancing a web of labels of either the liner type or the linerless type, a delaminator for delaminating labels from a carrier web, and a positioning mechanism for selectively positioning the delaminator and the print head relative to each other for delaminating and dispensing liner-type labels from a carrier web and for dispensing linerless-type labels.

4. A printer as defined in claim 3, wherein the positioning mechanism includes a slide for mounting the delaminator.

5. A printer as defined in claim 3, wherein the positioning mechanism includes a slide for mounting the delaminator, and a detent for releasably holding the slide in selected one of predetermined positions.

6. A printer as defined in claim 3, including a detent for releasably holding the delaminator in a selected one of a number of predetermined positions.

7. A printer as defined in claim 6, wherein the delaminator includes a peel roller.

8. A printer as defined in claim 3, including a manually graspable handle for changing the position of the delaminator.

9. A printer as defined in claim 3, wherein a slide mounts the delaminator, the slide having a pair of flexible resilient spring fingers, a pair of guide members for slidably mounting the slide, the guide members having respective recesses cooperable with the spring fingers for selectively releasably holding the slide in a selected position.

10. A printer as defined in claim 3, wherein the print head comprises a thermal print head.

11. A printer for printing and selectively dispensing liner-type labels wherein pressure sensitive labels are releasably adhered to a carrier web and linerless type pressure sensitive labels with pressure sensitive adhesive and arranged in a web, comprising: a print head for printing on labels, a delaminator for delaminating liner-type labels from their web, means for selectively positioning the delaminator relative to the print head for delaminating and dispensing liner-type labels from a carrier web and for dispensing linerless-type labels without the adhesive on the linerless-type labels contacting the delaminator.

12. A printer as defined on claim 11, wherein the print head comprises a thermal print head.

13. A printer for printing and selectively dispensing liner-type labels wherein pressure sensitive labels are releasably adhered to a carrier web and linerless-type labels arranged in a web and the linerless-type web having pressure sensitive adhesive on one side, comprising: a thermal print head for printing on labels, a driven platen roll cooperable with the print head, a selectively positionable delaminator to delaminate and dispense liner-type labels from a carrier web in one position of the delaminator and to enable the dispensing of linerless-type labels in another position of the delaminator, and wherein the adhesive on the linerless-type labels does not contact the delaminator in said other position.

14. A printer for printing and selectively dispensing liner-type labels wherein pressure sensitive labels are releasably adhered to a carrier web and linerless-type labels arranged in a web and the linerless-type web having pressure sensitive adhesive on one side, comprising: a print head for printing on labels, a platen cooperable with the print head, a selectively positionable delaminator to delaminate and dispense liner-type labels from a carrier web in one position of the delaminator and to enable the dispensing of linerless-type labels in another position of the delaminator, and wherein the adhesive on the linerless-type labels does not contact the delaminator in said other position.

15. A printer as defined in claim 14, wherein the print head comprises a thermal print head.

* * * * *